US006151753A

United States Patent [19]

Salutzki

[11] Patent Number: 6,151,753

[45] Date of Patent: Nov. 28, 2000

[54] DOOR CLOSER TO GENERATE A SUDDEN CHANGE IN THE TRANSMISSION RATIO DURING THE CLOSING PHASE

[75] Inventor: Thomas Salutzki, Witten, Germany

[73] Assignee: Dorma GmbH + Co. KG, Ennepetal, Germany

[21] Appl. No.: 09/224,033

[22] Filed: Dec. 31, 1998

Related U.S. Application Data

[63] Continuation-in-part of application No. PCT/DE97/01449, Jul. 9, 1997.

[30] Foreign Application Priority Data

Jul. 4, 1996 [DE] Germany ..... 196 26 831

[51] Int. Cl.[7] ..... E05F 3/04

[52] U.S. Cl. ..... 16/62; 16/49; 16/58; 16/79; 16/DIG. 17; 16/DIG. 21

[58] Field of Search ..... 16/62, 49, 51, 16/58, 79, 71, DIG. 9, DIG. 17, DIG. 20, DIG. 21; 49/340, 341, 342

[56] References Cited

U.S. PATENT DOCUMENTS

| | | | |
|---|---|---|---|
| 4,580,365 | 4/1986 | Sieg | 16/58 |
| 4,686,739 | 8/1987 | Fritsche et al. | 16/62 |
| 4,793,023 | 12/1988 | Simpson et al. | 16/62 |
| 4,967,444 | 11/1990 | Korling et al. | 16/62 |
| 5,259,090 | 11/1993 | Fayngersh | 16/52 |
| 5,488,896 | 2/1996 | Current | 92/129 |

FOREIGN PATENT DOCUMENTS

| | | |
|---|---|---|
| 4101640A1 | 7/1992 | Germany . |
| 19549372 | 10/1996 | Germany . |
| 19549373 | 10/1996 | Germany . |
| 0469342 | 6/1993 | Sweden . |

*Primary Examiner*—Chuck Y. Mah
*Attorney, Agent, or Firm*—Nils H. Ljungman & Associates

[57] ABSTRACT

A door closer with a door piston, which door piston is acted on by a driven shaft during the opening of a door. The door piston has an extension attached to it. The door closer also can have a pressure piston and an energy storage mechanism which acts on the pressure piston. The pistons can be axially guided and can interact with hydraulically connected pressure chambers to connect and disconnect the pistons during the opening and closing of the door closer.

20 Claims, 9 Drawing Sheets

DOOR CLOSER TO GENERATE A SUDDEN CHANGE IN THE TRANSMISSION RATIO DURING THE CLOSING PHASE

CONTINUING APPLICATION DATA

This application is a Continuation-In-Part application of International Application No. PCT/DE97/01449, filed on Jul. 9, 1997, which claims priority from Federal Republic of Germany Patent Application No. DE 196 26 831, filed on Jul. 4, 1996. International Application No. PCT/DE97/01449 was pending as of the filing date of the above-cited application. The United States was an elected state in International Application No. PCT/DE97/01449.

BACKGROUND OF THE INVENTION

1. Field of the Invention

The present invention relates to a door closer with a door piston, which door piston acts on a driven shaft and has an extension, a pressure piston and an energy storage mechanism which acts on the pressure piston. The pistons can be axially guided and can interact with hydraulically connected pressure chambers to connect and disconnect the pistons during the opening and closing of the door closer.

2. Background Information

Swedish Patent No. 469 342 B discloses a door closer in which a closing moment characteristic adapted to the door angle is achieved by first stretching or applying tension to a first spring which acts on the door piston, and then in series or sequence to a second spring which acts on a pressure piston or plunger or ram. When the door closes, first the spring which acts on the door piston transmits its energy, whereby the second spring remains in the stretched position until a slide which is mounted centrally in both pistons hydraulically relieves the pressure via a system of channels which keeps the pressure piston pressurized, so that the second spring can then give up its energy to the driven shaft.

Although this door closer is capable of exerting different moments on the door as a function of the opening of the door, it is extraordinarily expensive to manufacture.

In particular, it requires extremely precise and therefore expensive manufacturing techniques for both the door piston which is engaged with the pressure piston, and for the pressure piston itself. A complicating factor is that the pressure piston, in addition to the mating surface with the door piston, has two additional mating surfaces, corresponding to which there are two aligned mating surfaces on the housing. These requirements also significantly increase the manufacturing costs.

Finally, the door closer of the known art has a centrally located slide which functions as a switched valve and can be displaced axially both in the door piston and in the pressure piston, and is installed in a hydraulically tight manner. As a result, the diameter tolerances are cumulative, which sets extremely high requirements for precision in the manufacture of such a door closer.

The primary disadvantage, however, is that a large number of pressure or compression chambers are required, all of which must be sealed off from one another and some of which must be in hydraulic communication with one another by means of a complicated system of channels, which means that the desired closing moment characteristic is greatly affected by the temperature—in cold weather in particular. The door closer of the known art also relies heavily on the skill of the assembly and installation personnel, because the hydraulically active cylinder surfaces which are engaged with one another can easily be damaged when the door piston and the pressure piston are assembled to one another, along with the slide which runs through both of them.

OBJECT OF THE INVENTION

The object of the present invention is therefore to create a simple door closer which can be manufactured particularly economically and which is capable of realizing different moment curves.

SUMMARY OF THE INVENTION

The present invention teaches that this object can be accomplished in a door closer with a door piston, which door piston can act on a driven shaft and have an extension, a pressure piston and an energy storage mechanism which can act on the pressure piston. The pistons can be guided so that they can move axially in a housing. The door closer can have a first pressure chamber and a second pressure chamber which can be connected by means of an overflow line and correspond to the door piston, a middle pressure chamber which corresponds to the extension and the pressure piston, and at least one additional pressure chamber which corresponds to the pressure piston. The overflow line can have a choke and the pistons or the housing can have respective channels connecting the pressure chambers. The door piston can be effectively connected, first hydraulically and then mechanically, in positive or form-fitting or frictional contact by means of the stepped extension in the opening direction with the pressure piston, and in the closing direction so that the door piston can be hydraulically uncoupled from the pressure piston.

On a door closer in accordance with the present invention, there are no pistons that are engaged with one another. Furthermore, only one single pressure reservoir is required. The expense for fabrication and assembly can be significantly reduced. The mating surfaces of the housing and of the piston which correspond to one another can be fabricated in a single chucking operation, as a result of which the accurate tracking of the corresponding cylinder and piston surfaces can be significantly improved at essentially no additional expense or effort, while on the other hand, the number of processing cycles can be reduced. The configuration in accordance with the present invention also can significantly simplify the system of channels, so that no long channels are required, and therefore the evacuation which must be performed during the assembly process can be greatly simplified. Leakage is also practically eliminated.

In one particularly advantageous configuration of the door closer claimed by the invention, a central pressure chamber is hydraulically connected:

- on one hand with a second pressure or compression chamber of a channel which corresponds to the extension or neck of the door piston, and can be closed or opened as a function of the displacement of the door piston;
- and on the other hand, with an additional pressure chamber by means of a channel which has a non-return valve which is active in the direction away from the center pressure chamber;
- and the second pressure chamber, which is hydraulically connected with the additional pressure chamber corresponding to the pressure piston, by means of a channel which has a non-return valve, as well as with the overflow line and with a channel for which there is a corresponding isolating valve which is normally open and which is moved into its closed position when the pressure in the first pressure chamber increases.

In this case, the channel which connects the middle pressure chamber and an additional pressure chamber, along with the non-return valve, can be located in the pressure piston or in the housing, depending on the space available.

To control the closing speed of a door closer in accordance with the present invention, the space in a pressure chamber can be divided into a first part and a second part, in which case the two spaces are hydraulically connected to one another by means of a flow cross section which acts as a choke or throttle.

It is advantageous if, on the two pistons, the piston surfaces which face one another are realized so that they cannot adhere to one another.

In particular, the present invention teaches that the requirement for a modular structure can be met if the two pistons have one housing, and the energy storage mechanism has an additional housing, whereby the housing of the door closer and the housing of the energy storage mechanism are preferably coupled together by means of a radial threaded connection. In this case, all that is required is a standard type of housing which contains the pistons, whereby the housings which are best-suited to the different closing forces required can easily be bolted on. It is therefore unnecessary to use complicated assembly processes like those which are necessary in similar known systems.

Adjustment means which are accessible from outside can advantageously be provided for the energy storage mechanism in the housing, whereby the closing force can be adjusted continuously through a wide range.

The present invention also teaches that it is advantageous if the actuatable isolating valve is a 2/2-way valve that can be actuated mechanically, hydraulically, pneumatically or electrically, whereby corresponding to the first pressure chamber there are means to actuate the isolating valve as a function of the pressure.

For the realization of an overload protection, the present invention teaches that it can have an overpressure valve which interrupts the flow toward or isolates the first pressure chamber and is parallel to the choke.

Additional advantageous configurations in accordance with the present invention are discussed herein.

The above discussed embodiments of the present invention will be described further hereinbelow with reference to the accompanying figures. When the word "invention" is used in this specification, the word "invention" includes "inventions," that is, the plural of "invention." By stating "invention," the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The present invention is also described in greater detail below with reference to the embodiments which are more or less schematically illustrated in the accompanying drawings.

DESCRIPTION OF THE PREFERRED EMBODIMENT

Figure 1A:
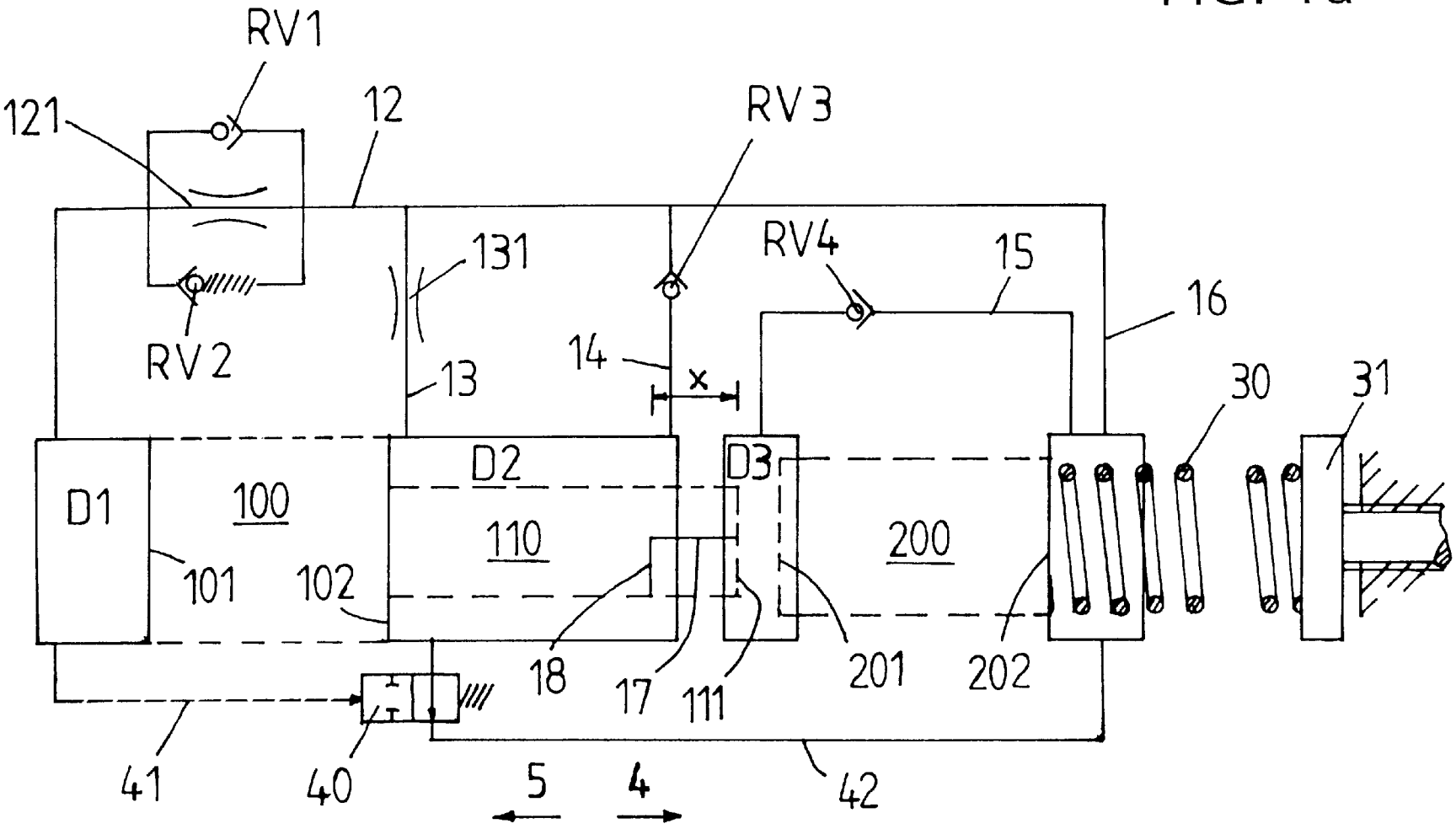
FIG. 1*a* shows the structure of a door closer in accordance with the present invention.

In the figures, parts identified by the same numbers are substantially identical. The first part of the following description relates to FIG. 1*a,* which illustrates the basic structure and function of the present invention in greater detail.

A door piston 100 acts to the left with a piston surface 101 on a pressure chamber D1 and to the right with a piston surface 102 on a pressure chamber D2, whereby the two pressure chambers D1 and D2 are hydraulically connected by means of overflow lines 12 and 13. Both the overflow line 12 and the overflow line 13 each have an adjustable choke 121 and 131, respectively. The overflow line 12 also has a non-return valve RV1 which closes in the direction of the flow from pressure chamber D1 to pressure chamber D2, and is switched parallel to the choke 121. For overload protection, there is a safety non-return valve RV2 parallel to the choke 121.

The pressure chamber D2 is connected on the side opposite the piston surface 102 by a line 14 which has a non-return valve RV3 to the overflow line 12, and the direction of action of the non-return valve RV3—viewed in the flow direction—is directed toward the overflow line 12.

To further explain, in one possible embodiment of the present invention, the pressure chamber D2 can be connected to the overflow line 12 on the side opposite the piston surface 102 by a line 14. Line 14 can have a non-return valve RV3 in the path to the overflow line 12. The non-return valve RV3 can be designed to substantially prevent the flow of fluid in a direction from the pressure chamber D2 to the overflow line 12.

To the right, the door piston 100 has a smaller-diameter extension or neck 110 which runs through the pressure chamber D2, and the effective piston surface 111 of which acts on a middle pressure chamber D3. To the right of the middle pressure chamber D3 there is a pressure piston 200 which acts with its left piston surface 201 on the middle pressure chamber D3. This pressure piston 200 has, on the right, an additional pressure chamber D4 (see FIG. 1*b*), on which the pressure piston 200 acts with its right piston surface 202, and on which a compression spring 30 presses, which spring is supported in a stationary manner on a pressure plate or spring washer 31.

In other words, in one possible embodiment of the present invention, to the right, the door piston 100 can have a smaller-diameter extension or neck 110 which runs through the pressure chamber D2. The effective piston surface 111 of the extension 110 can act on a middle pressure chamber D3.

To the right of the middle pressure chamber D3 there is a pressure piston 200 which acts with its left piston surface 201 on the middle pressure chamber D3. The pressure piston 200 can act with its right piston surface 202 on an additional pressure chamber D4. A compression spring 30 can be located in the pressure chamber D4. The compression spring 30 can press on the piston surface 202, which spring can be supported in a stationary manner on a pressure plate or spring washer 31.

The pressure chamber D4 and the middle pressure chamber D3 are hydraulically connected by means of a line 15, whereby this line has a non-return valve RV4 which closes—viewed in the direction of flow—toward the pressure chamber D4. There is also an effective hydraulic connection via a line 16 between the pressure chamber D4 and the overflow line 12.

The pressure chamber D1 acts hydraulically by means of a control line 41 on an isolating valve 40 which is realized in the form of a 2/2-way valve, and in its initial or rest position connects the pressure chamber D2 to the additional pressure chamber D4 by means of a line 42.

Figure 2:
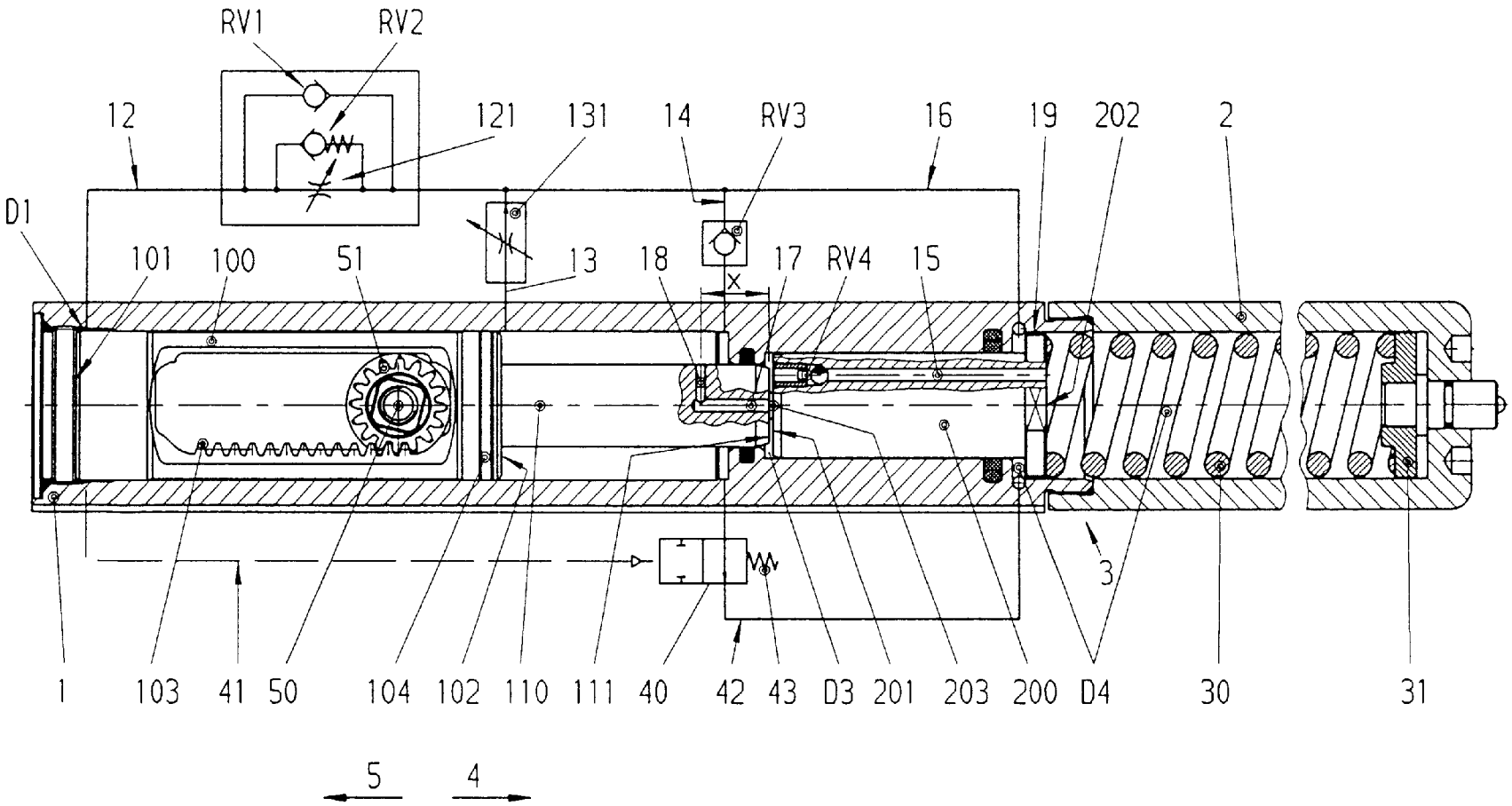
FIG. 2 shows an embodiment of a door closer in accordance with the present invention.

As seen in FIG. 2, the door piston 100 has gear teeth 103, by means of which the rotational movement of a pinion 51 on the driven shaft 50 which is in rolling engagement with the gear teeth 103 is converted into an axial movement of the door piston 100. The part of the piston 100 which has the gear teeth 103 is filled with fluid. The piston, on the side facing the piston surface 102, also has a radial seal 104. In this manner, the space which contains the gear teeth corresponds or communicates hydraulically directly with the pressure chamber D1, whereby the fluid lubricates the gear teeth 103 and the pinion 51 simultaneously.

The extension 110 also has a boring 17 which, emerges in the piston surface 111, in which boring 17 emerges a transverse boring 18 which is oriented substantially at a right angle in the extension 110 and extends to the boring 17. The transverse boring 18 is located at an axial distance x from the piston surface 111. This distance x defines the location with regard to the angle of rotation, represented by the Greek lower case phi, of the door when a change in the transmission ratio is to occur, i.e. when in terms of control, the specified position y at which a strong closing force is desired. The piston and its surfaces are illustrated by the broken lines in FIG. 1.

In other words, in one possible embodiment of the present invention, the extension 110 can have a boring 17 which emerges from the piston surface 111. The boring 17 can be connected to a transverse boring 18, which transverse boring 18 can be oriented at a substantially right angle to the surface of the extension 110 and can extend to the boring 17. The transverse boring 18 can be located at an axial distance x from the piston surface 111. The point at which a change in the transmission ratio of the closing door occurs can be partly determined by the distance x. The transverse boring 18 can be positioned at distance x in the extension 110 so that during the closing motion of the door, when a desired angle of rotation of the door has been reached, the transverse boring 18 can be correspondingly positioned according to the distance x and the movement of the extension 110 to cause a change in transmission ratio of the closing force, for example, from a stronger to a weaker closing force. A position of the piston 100 and its surfaces can be illustrated by the broken lines in FIG. 1.

Figure 1B:
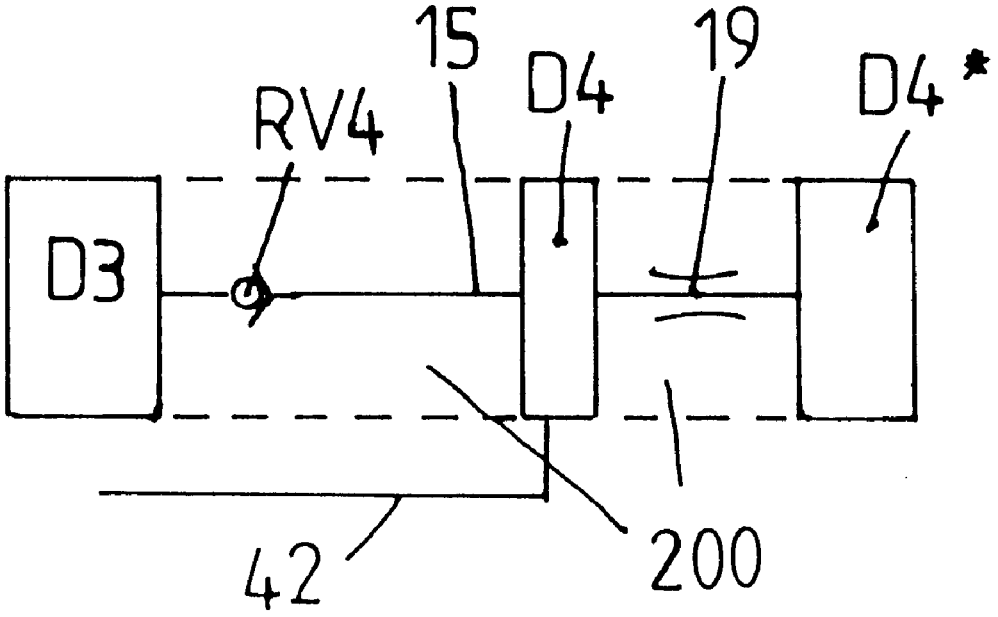
FIG. 1*b* shows a detail of an alternative configuration of a door closer in accordance with the present invention.

As shown in FIGS. 1*b* and 2, the line 15 and the non-return valve RV4 can also correspond to the pressure piston 200. The pressure piston 200 can also divide the pressure chamber D4 into a pressure chamber D4 (first part) and a pressure chamber D4* (second part) which contains the spring 30, whereby between the two chambers D4 and D4* there is a flow cross section 19 which can also have a choke function. For the precision adjustment of the spring force, the abutment of the spring 30 on the housing side is realized in the form of an axially adjustable spring washer 31.

Figure 3A:
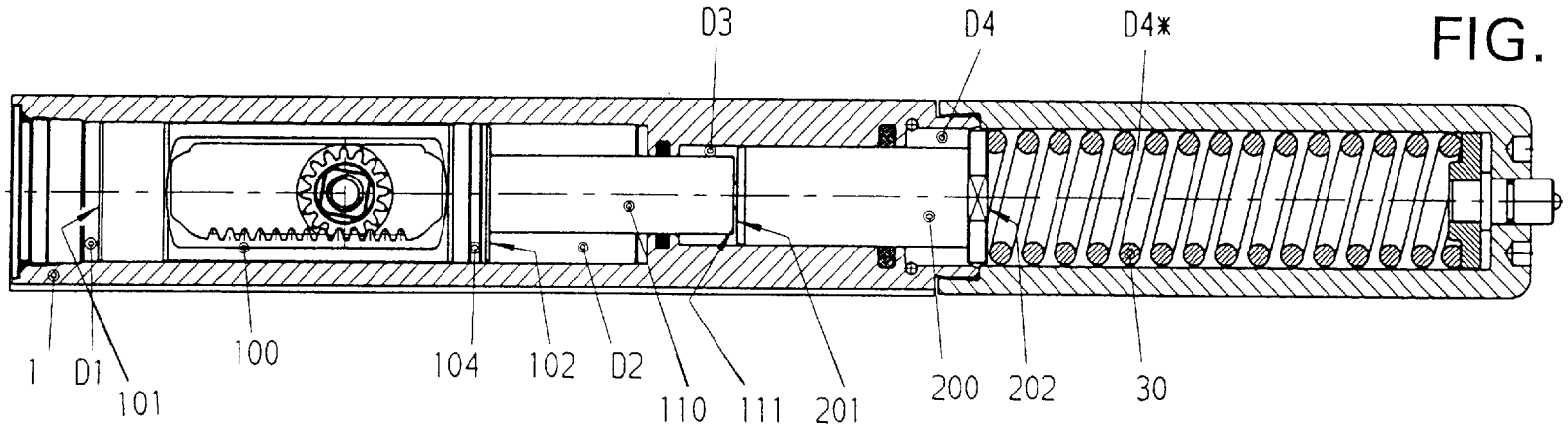
FIG. 3*a* shows the embodiment of the present invention when the door is closed.
Figure 3B:
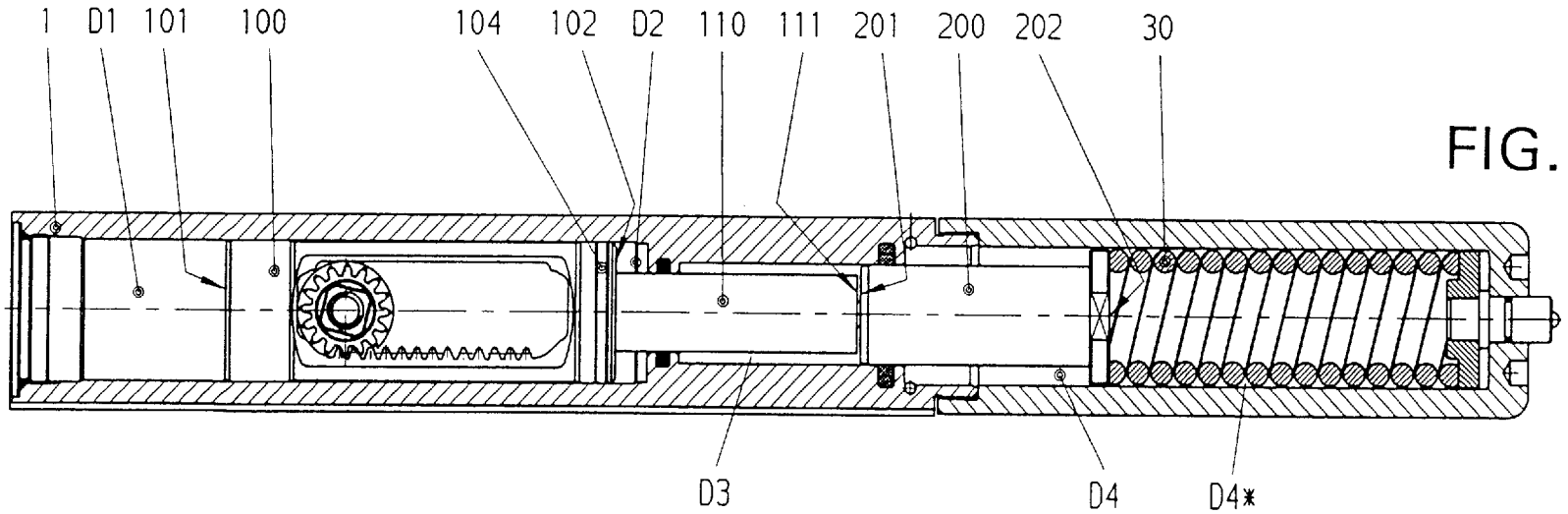
FIG. 3*b* shows the embodiment when the door begins to open.
Figure 3C:
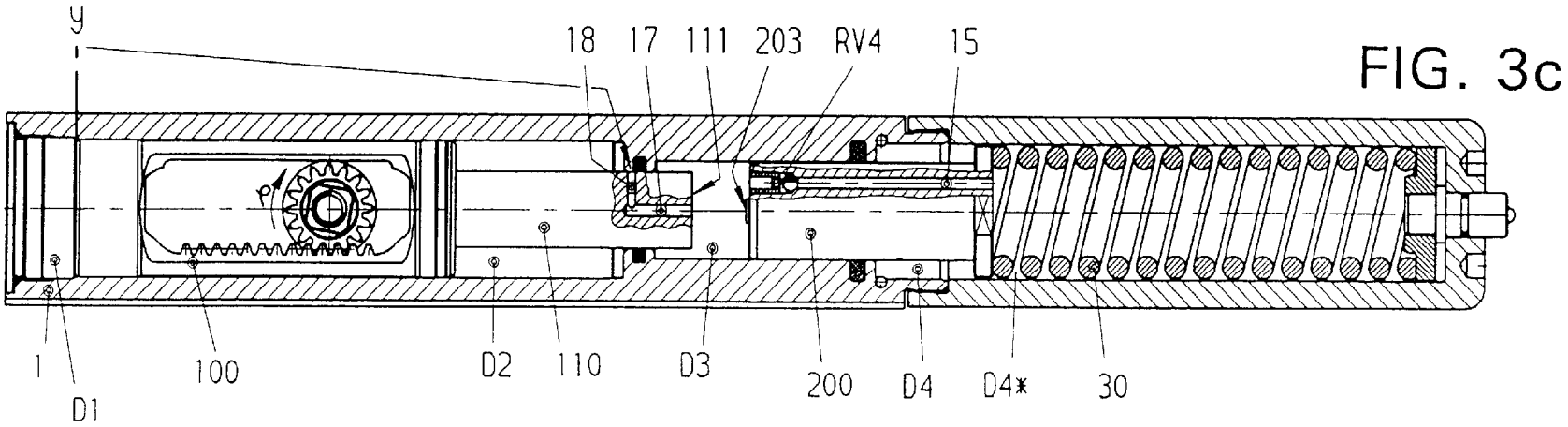
FIG. 3*c* shows the embodiment when the door is open.

As illustrated in FIGS. 2 and 3*c*, the piston surface 201 of the pressure piston 200 has a lathe-turned portion 203 which has a smaller diameter, so that between the piston surfaces 111 and 201, no adhesion forces can occur which might prevent the detachment of the door piston 100. For this purpose, one or both of the piston surfaces 111 and/or 201 can also have a spherical shape, or the extension 110 can also have a lathe-turned portion 203.

The diameters of the pistons must be selected so that the diameter of the extension 110 is smaller than the diameter of the door piston 100, but the diameter of the pressure piston 200 is larger than the diameter of the extension 110, which in turn is smaller than the diameter of the door piston 100.

In other words, in one possible embodiment of the present invention, the extension 110 can have a smaller diameter than both the pressure piston 200 and the door piston 100.

The spaces which result from the formation of the compression chambers, channels and lines are filled with hydraulic fluid and evacuated.

In the starting position, as illustrated in FIGS. 2 and 3*a*, the door piston 100 plus the extension 110 is in its starting or idle position, which corresponds to the closed doors.

This starting position is forcibly maintained by the piston surface 201 of the pressure piston 200 which acts in a positive or interlocking or form-fitting manner on the piston surface 111 of the extension 110.

Figure 4:
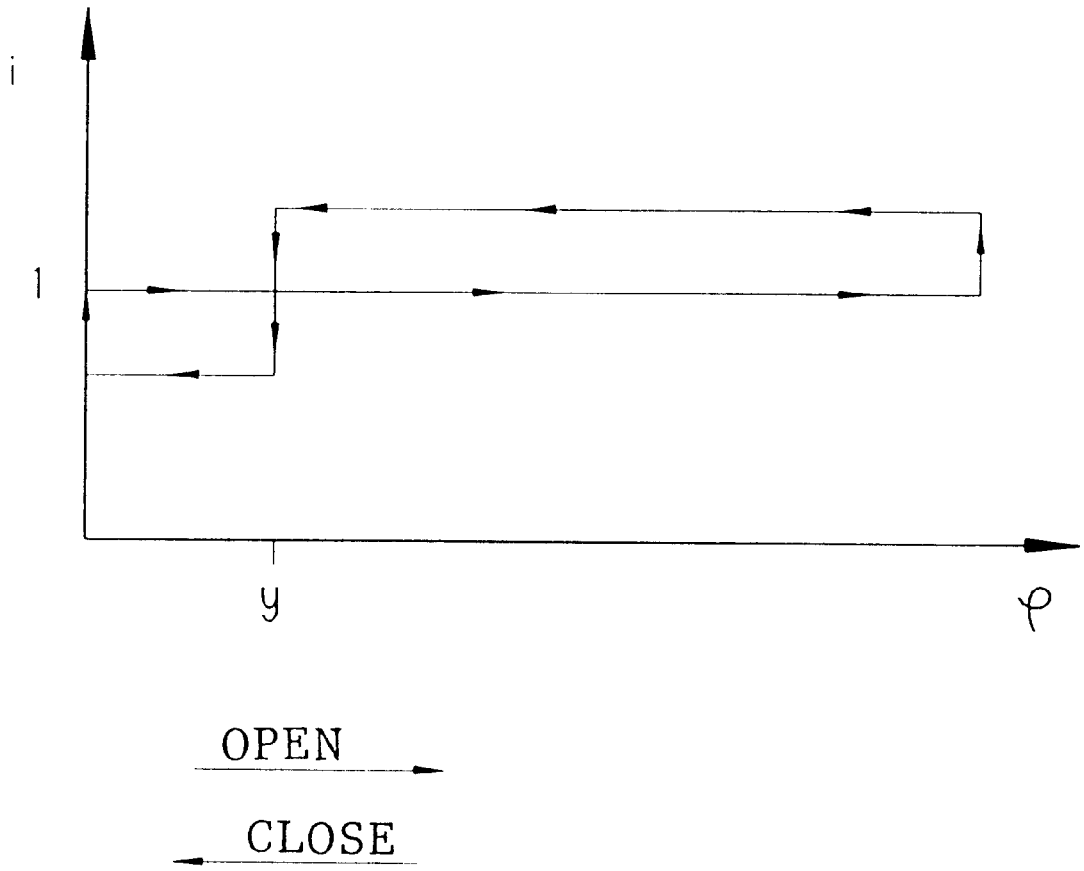
FIG. 4 is a graph of the transmission ratio of the door closer as a function of the angle of rotation of the door.

When the door is opened, as illustrated in FIG. 3*b*, the door piston 100 and the pressure piston 200, in a form-fitting connection, begin to move to the right, corresponding to the opening movement of the door transmitted from the driven shaft 50 and the pinion 51 to the toothed rack or gear teeth 103. In this case, fluid flows out of the pressure chamber D2 via the line 42 and the opened 2/2-way isolating valve into the pressure chamber D4. The line 14 is closed by the non-return valve RV3. The volume of fluid displaced by the pressure piston 200, as it enters the pressure chamber D4, flows proportionally via the line 16 and the overflow line 12 into the pressure chamber D1, whereby the non-return valve RV1 is opened. Fluid flows via the line 15 which is located in the pressure piston 200 into the expanding middle pressure chamber D3. This relationship—i.e. a transmission ratio of i=1—is retained until the limit positions of the pistons 100 and 200 which correspond to the maximum open position of the doors are reached, as shown in FIG. 4.

If no additional force is exerted on the door in the opening direction 4, the force of the spring 30 acting on the pressure piston 200 moves the pressure piston 200 in the closing direction 5, whereby simultaneously the non-return valve RV4 prevents fluid from leaving the middle pressure chamber D3, and as a result of the pressure increase in the pressure chamber D1, the isolating valve 40 which is realized in the form of a 2/2-way valve is switched by means of the control line 41 into its isolating position, and thus the line 42 is interrupted. As a result, only more fluid flows out of the pressure chamber D1 via the overflow line 12, and only more via the line 14, choked by the choke 121, proportionally into the pressure chambers D2 and D4.

To further explain, in one possible embodiment of the present invention, if no additional force is exerted on the door in the opening direction 4, the force of the spring 30 acting on the pressure piston 200 moves the pressure piston 200 in the closing direction 5, whereby simultaneously the non-return valve RV4 prevents fluid from leaving the middle pressure chamber D3. As a result of the pressure increase in the pressure chamber D1, the isolating valve 40, which is realized in the form of a 2/2-way valve, is switched by means of the control line 41 into its isolating position, and thus the line 42 is interrupted. As a result, the only fluid that continues to flow flows out of the pressure chamber D1 via the overflow line 12, choked by the choke 121, and via the lines 14 and 16, proportionally into the pressure chambers D2 and D4.

A determined volume is displaced by the pressure piston 200 per unit of movement of the pressure piston 200. Corresponding to the smaller diameter of the extension 110 of the door piston 100, that results—because the middle pressure chamber D3 is hydraulically sealed—in a transmission ratio of i greater than 1. Consequently, the door piston 100 detaches from the pressure piston 200.

The transmission ratio i—as illustrated in FIG. 4—remains unchanged until the transverse boring 18 of the centrally located boring 17, which transverse boring 18 runs through the extension 110 and corresponds to the desired position y, creates a hydraulic connection between the pressure chamber D3 and the pressure chamber D2. At this point, the transmission ratio changes suddenly to a transmission ratio i less than 1, i.e. a step-down transmission, until the end surface 201 of the pressure piston 200 is once again in contact with the pressure surface 111 corresponding to the extension, and the transmission ratio again becomes essentially 1:1.

In other words, in one possible embodiment of the present invention, the extension 110 can be moved so that the transverse boring 18 and the boring 17 can establish a hydraulic connection between pressure chambers D2 and D3. Up until the point of connection, the transmission ratio i can remain unchanged at an i of greater than one. When the hydraulic connection between the pressure chamber D3 and the pressure chamber D2 is established, the transmission ratio i can change suddenly to a transmission ratio i less than 1, i.e. a step-down transmission, due the evacuation of fluid from chamber D3 into D2 via the boring 17 and transverse boring 18. The step-down transmission can occur until the end surface 201 of the pressure piston 200 is once again in contact with the pressure surface 111 of the extension, and the transmission ratio can again become essentially i=1.

The overpressure valve RV2 can essentially prevent damage to the door closer in the event force is exerted on the doors from the outside.

FIG. 2 also shows that the pistons have a housing 1, and the spring 30 is installed in an additional housing 2 which is connected to the housing 1 by means of a threaded connection 3. In this manner, the requirement for closing springs of different strengths can be satisfied particularly easily. As a result of the adjustment means in the form of a spring washer 31 which presses on the spring, is located in the additional housing and is accessible from outside, the spring can be both biased and also precision-adjusted particularly easily.

Figure 3D:
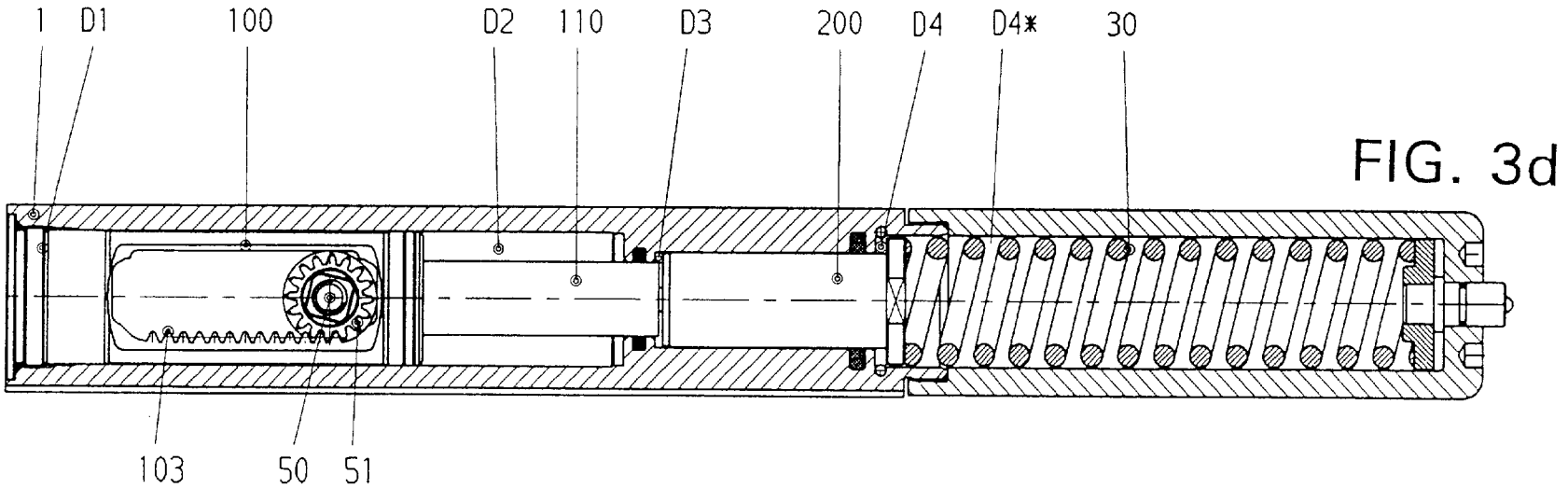
FIG. 3*d* shows the embodiment when there is a reversal of the transmission ratio during the closing process.

FIG. 3*d* shows the embodiment of the present invention shown in FIG. 2 when the door is closed.

Figure 5:
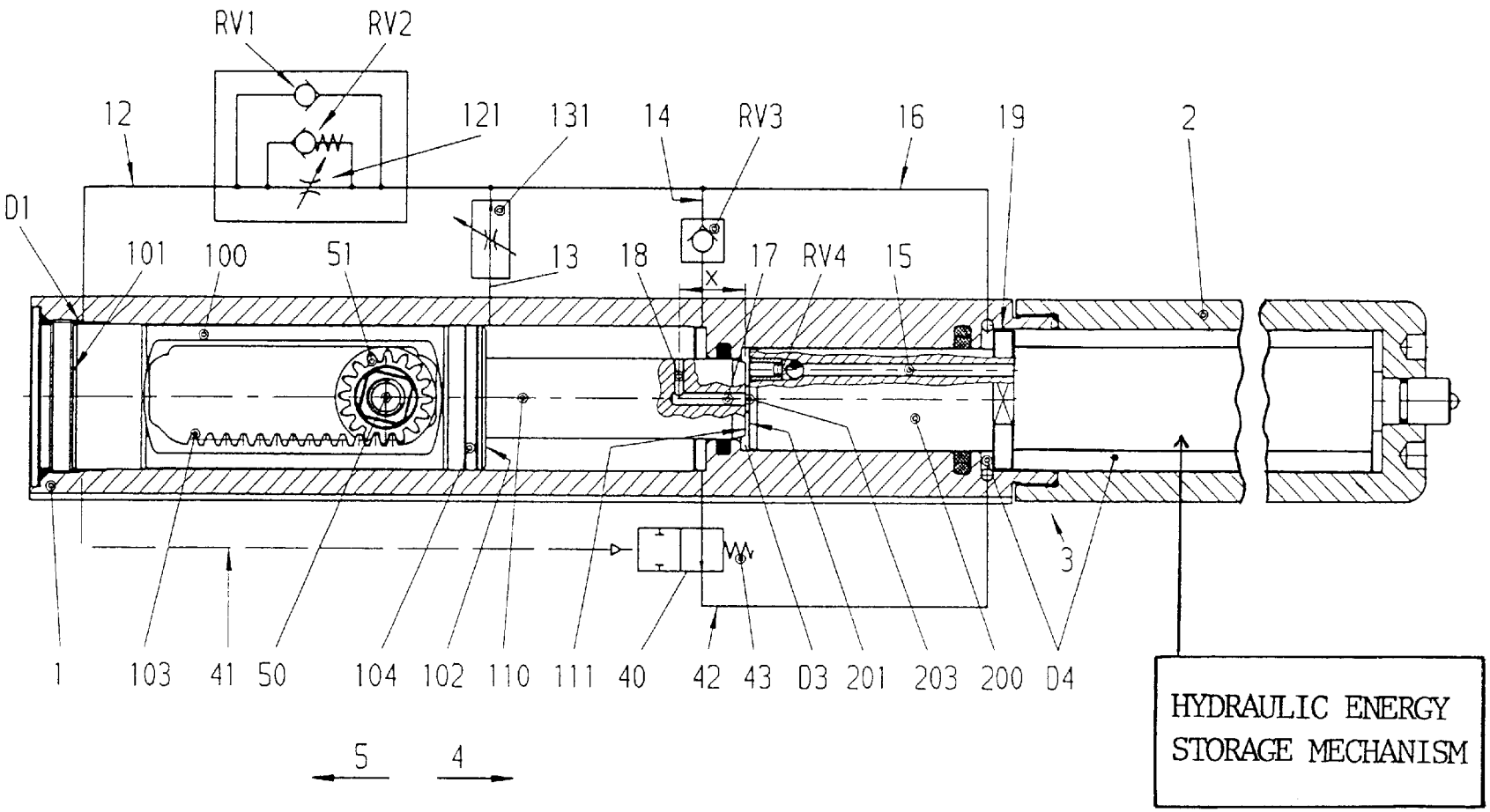
FIG. 5 shows an embodiment of the door closer with a hydraulic energy storage mechanism.

FIG. 5 shows an embodiment of the door closer with a hydraulic energy storage mechanism.

Figure 6:
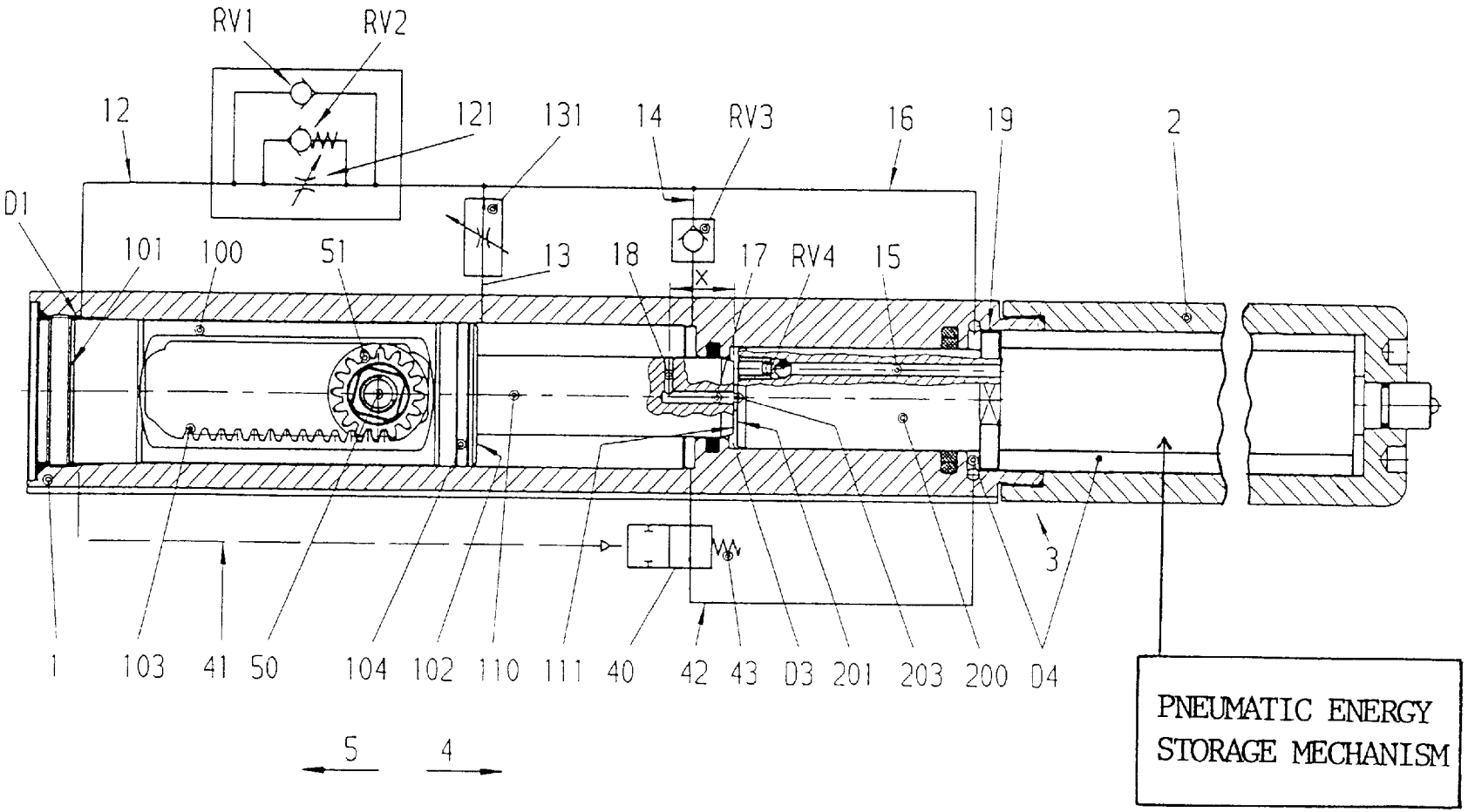
FIG. 6 shows an embodiment of the door closer with a pneumatic energy storage mechanism.

FIG. 6 shows an embodiment of the door closer with a pneumatic energy storage mechanism.

Figure 7:
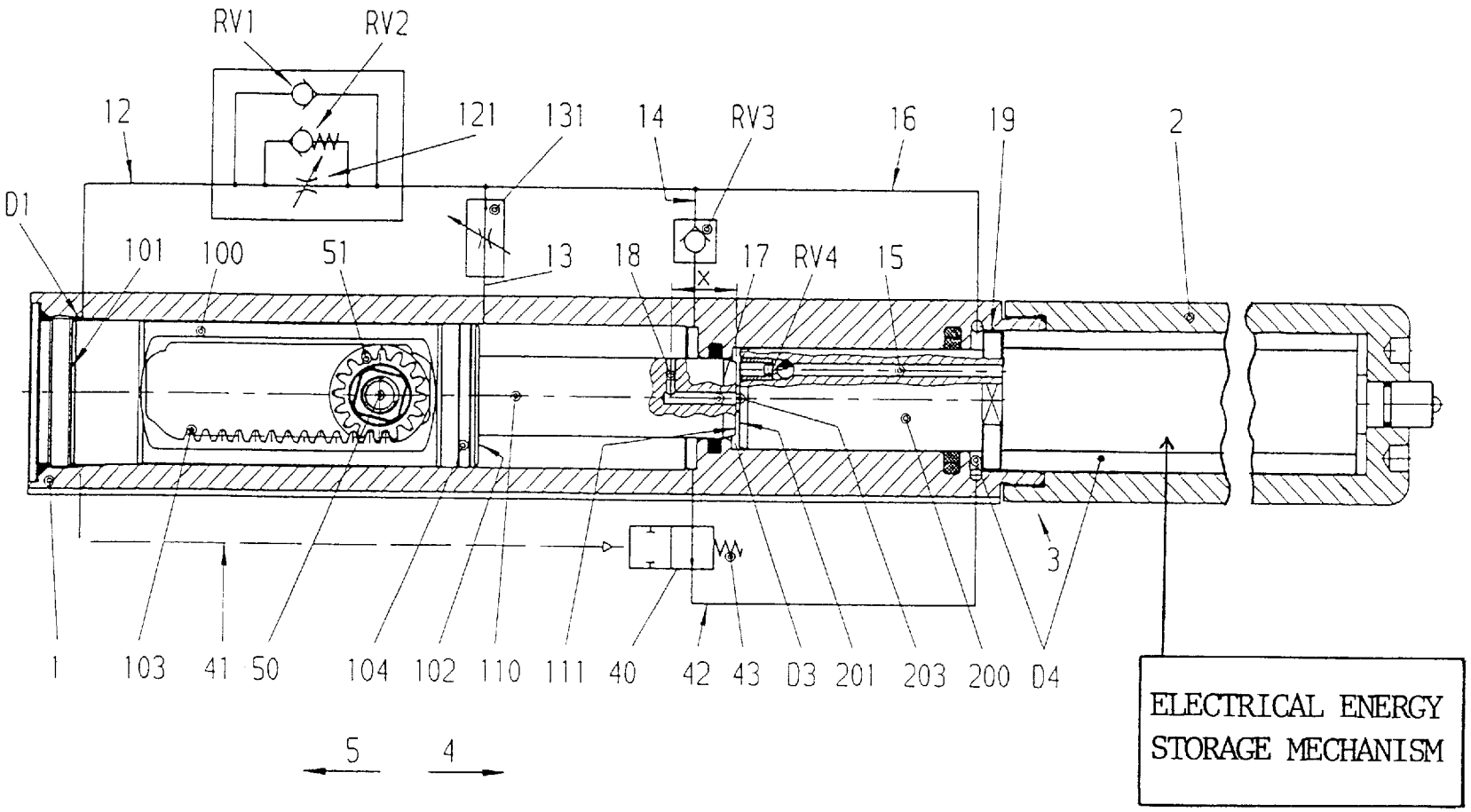
FIG. 7 shows an embodiment of the door closer with an electrical energy storage mechanism.

FIG. 7 shows an embodiment of the door closer with an electrical energy storage mechanism.

One feature of the invention resides broadly in the door closer with a door piston 100, which door piston acts on a driven shaft 50 and has an extension 110, a pressure piston 200 and an energy storage mechanism 30 which acts on the pressure piston 200, whereby the pistons 100, 200 are guided so that they can move axially in a housing 1, and with a first pressure chamber D1 and a second pressure chamber D2 which are connected by means of an overflow line 12 and correspond to the door piston 100, a middle pressure chamber D3 which corresponds to the extension 110 and the pressure piston 200, and at least one additional pressure chamber D4, D4* which corresponds to the pressure piston 200, whereby the overflow line 12 can have a choke and the pistons or the housing have respective channels connecting the pressure chambers, and whereby the door piston 100 is effectively connected, first hydraulically and then mechanically, in positive or form-fitting contact by means of the stepped extension 110 in the opening direction 4 with the pressure piston 200, and in the closing direction 5 so that it can be hydraulically uncoupled from the pressure piston.

Another feature of the invention resides broadly in the door closer characterized by the fact that the middle pressure chamber D3 is hydraulically connected on one hand with the second pressure chamber D2 by means of a channel (transverse boring 18, boring 17) that corresponds to the extension 110 of the door piston 100 and can be closed or opened as a function of the direction of displacement of the door piston 100, and on the other hand with the additional pressure chamber D4 by means of a channel 15 which has a non-return valve RV4 which acts in the direction away from the middle pressure chamber D3, and that the second pressure chamber D2 is hydraulically connected to the additional pressure chamber D4 corresponding to the pressure piston 200 by means of a channel 14, 16 which has a non-return valve RV3, and with the overflow line 12 and with a channel 42 which has an isolating valve 40 which is normally open, and which is switched into its isolating position when the pressure in the first pressure chamber D1 increases.

Yet another feature of the invention resides broadly in the door closer characterized by the fact that the channel 15 connecting the middle pressure chamber D3 and the additional pressure chamber D4, plus the non-return valve RV4, is located in the pressure piston 200 or housing 1.

Still another feature of the invention resides broadly in the door closer characterized by the fact that the pressure chamber D4 is divided into a first part D4 and a second part D4*, whereby the chambers D4, D4* are hydraulically connected to one another by means of a flow cross section 19 which can be realized so that it acts as a choke.

A further feature of the invention resides broadly in the door closer characterized by the fact that the piston surfaces 111, 201 facing one another of the two pistons 100, 200 are realized so that they are prevented from sticking together by adhesion.

Another feature of the invention resides broadly in the door closer characterized by the fact that the side of the door piston 100 which has the piston surface 102 has a radial seal 104.

Yet another feature of the invention resides broadly in the door closer characterized by the fact that the two pistons 100, 200 have one housing 1 and the energy storage mechanism 30 has an additional housing 2.

Still another feature of the invention resides broadly in the door closer characterized by the fact that the housing 1 and the housing 2 are coupled to one another by means of a radial threaded connection 3.

A further feature of the invention resides broadly in the door closer characterized by the fact that the housing 2 has an externally accessible adjustment means spring washer 31 which corresponds to the energy storage mechanism 30.

Another feature of the invention resides broadly in the door closer characterized by the fact that the energy storage mechanism 30 is realized in the form of a mechanical, hydraulic, pneumatic or electrical energy storage mechanism, whereby it can have a linear or progressive characteristic.

Yet another feature of the invention resides broadly in the door closer characterized by the fact that the actuatable isolating valve 40 is a mechanically, hydraulically, pneumatically or electrically actuatable 2/2-way valve, whereby corresponding to the first pressure chamber D1 there are means for the pressure-dependent actuation control line 41 of the isolating valve 40.

Still another feature of the invention resides broadly in the door closer characterized by the fact that the overflow line 12, instead of the choke 12, parallel to the choke, has a non-return valve RV3 that closes the direction of flow from the first pressure chamber D1 to the second pressure chamber D2.

A further feature of the invention resides broadly in the door closer characterized by the fact that the overflow line 12, instead of the choke 121, parallel to the choke, has an overflow valve RV2 which isolates or cuts off the flow in the direction of flow toward the first pressure chamber D1.

Examples of door closers that could be adapted for use in the context of the present invention and include components that could be adapted for use in embodiments of the present invention could be disclosed by the following U.S. patents and U.S. patent applications: U.S. Pat. No. 5,802,670, issued on Sep. 8, 1998 to inventor Bienek; U.S. Pat. No. 5,789,887, issued on Aug. 4, 1998 to inventor Elischewski; U.S. Pat. No. 5,311,642, issued on May 17, 1994 to inventors Tillman et al.; U.S. Pat. No. 5,706,551, issued on Jan. 13, 1998 to inventors Jeynes et al.; U.S. Pat. No. 5,535,514, issued on Jul. 16, 1996 to inventor Lucas; U.S. Pat. No. 5,488,896, issued on Feb. 6, 1996 to inventor Current; U.S. Pat. No. 5,432,977 issued on Jul. 18, 1995 to inventors Reid et al.; U.S. Pat. No. 5,272,787 issued on Dec. 18, 1993 to inventors Salena et al.; Ser. No. 08/733,226 filed on Oct. 17, 1996 by inventors Krumhauer et al.; Ser. No. 08/735,970 filed on Oct. 23, 1996 by inventor Bienek; and Ser. No. 08/938,223 filed on Sep. 26, 1997 by inventor Jentsch.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign and international patent publication applications, namely, Federal Republic of Germany Patent Application No. DE 196 26 831, filed on Jul. 4, 1996, having inventor Thomas Salutzki, and DE-OS DE 196 26 831 and DE-PS DE 196 26 831 and International Application No. PCT/DE97/01449, filed on Jul. 9, 1997, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

At Least Partial Nomenclature

1 Housing
2 Housing
3 Threaded connection
4 Opening direction
5 Closing direction
12 Overflow line
13 Overflow line
14 Line
15 Line
16 Line
17 Boring
18 Transverse boring
19 Flow cross section
30 Compression spring
31 Spring washer
40 Isolating valve (2/2-way valve)
41 Control line
42 Line
50 Driven shaft
51 Pinion
100 Door piston
101 Piston surface
102 Piston surface
103 Gear teeth
104 Radial seal
110 Extension
111 Piston surface
121 Choke
131 Choke
200 Pressure piston
201 Piston surface
202 Piston surface
203 Lathe-turned portion
x Distance
y Specified position
D1 Pressure chamber D2 Pressure chamber
D3 Pressure chamber
D4 Pressure chamber (first part)
D4* Pressure chamber (second part)
RV1 Non-return valve
RV2 Safety non-return valve
RV3 Non-return valve
RV4 Non-return valve
[Greek lower case phi] Angle of rotation

What is claimed is:

1. A door-closing apparatus for the closing of doors, said door-closing apparatus comprising:

a door-closing apparatus housing;

a piston arrangement being disposed within said door-closing apparatus housing;

said piston arrangement comprising:

a door piston;

said door piston being configured and disposed to be axially displaced by the movement of a door;

an extending portion;

said extending portion being attached to said door piston and disposed to extend in an axial direction from said door piston;

a pressure piston;

said pressure piston being configured and disposed to exert a force on a fluid medium;

an energy storage mechanism;

said energy storage mechanism being configured and disposed to exert a force on said pressure piston;

said door piston and said pressure piston being disposed in said door-closing apparatus housing and configured to be axially movable in said door-closing apparatus housing;

a first pressure chamber being disposed in said door-closing apparatus housing;

a second pressure chamber being disposed in said door-closing apparatus housing;

a line arrangement being disposed in said door-closing apparatus housing;

said first pressure chamber and said second pressure chamber being connected by said line arrangement to permit flow of fluid between said first pressure chamber and said second pressure chamber;

said door piston being configured and disposed to exert a force directly on a fluid medium in said first pressure chamber and to exert a force directly on a fluid medium in said second pressure chamber;

at least one additional pressure chamber;

said at least one additional pressure chamber being disposed adjacent said pressure piston;

said pressure piston being configured and disposed to exert a force on a fluid medium in said at least one additional pressure chamber;

a middle pressure chamber being disposed between said second pressure chamber and said at least one additional pressure chamber;

said middle pressure chamber being disposed adjacent at least one of said extending portion and said pressure piston;

at least one of said extending portion and said pressure piston being configured and disposed to exert a force on a fluid medium in said middle pressure chamber;

a hydraulic connection;

said hydraulic connection being configured to hydraulically connect said door piston to said pressure piston to permit said door piston to hydraulically move said pressure piston during an opening operation;

said hydraulic connection being physically disposed to hydraulically connect said door piston to said pressure piston to permit said door piston to hydraulically move said pressure piston during an opening operation;

said hydraulic connection being configured to hydraulically connect said door piston to said pressure piston to permit said pressure piston to hydraulically move said door piston during a closing operation;

said hydraulic connection being physically disposed to hydraulically connect said door piston to said pressure piston to permit said pressure piston to hydraulically move said door piston during a closing operation;

said door piston being configured to permit contact of said pressure piston with said extending portion to permit said door piston to mechanically move said pressure piston during an opening operation;

said door piston being physically disposed to permit contact of said pressure piston with said extending portion to permit said door piston to mechanically move said pressure piston during an opening operation;

said door piston being configured to permit contact of said pressure piston with said extending portion to permit said pressure piston to mechanically move said door piston during a closing operation;

said door piston being physically disposed to permit contact of said pressure piston with said extending portion to permit said pressure piston to mechanically move said door piston during a closing operation;

said door piston in combination with said hydraulic connection being configured to first hydraulically and then mechanically move said pressure piston during an opening operation;

said door piston in combination with said hydraulic connection being physically disposed to first hydraulically and then mechanically move said pressure piston during an opening operation;

said pressure piston in combination with said hydraulic connection being configured to first hydraulically and then mechanically move said door piston during a closing operation; and said pressure piston in combination with said hydraulic connection being physically disposed to first hydraulically and then mechanically move said door piston during a closing operation.

2. The door closing apparatus according to claim 1, wherein:

said piston arrangement further comprises a first channel;

said first channel is disposed in said extending portion and configured to hydraulically connect said middle pressure chamber with said second pressure chamber;

said piston arrangement further comprises a second channel;

said second channel is configured and disposed to hydraulically connect said second pressure chamber with said at least one additional pressure chamber;

said second channel comprises a valve;

said valve is configured and disposed to permit fluid to flow from said at least one additional pressure chamber to said middle pressure chamber through said second channel, and to substantially prevent the flow of fluid from said middle pressure chamber to said at least one additional pressure chamber through said second channel;

said hydraulic connection comprises an isolating valve;

said isolating valve is configured and disposed to permit the flow of fluid from said second pressure chamber to said at least one additional pressure chamber;

said isolating valve is configured to be closed in order to substantially prevent the flow of fluid from said second pressure chamber to said at least one additional pressure chamber through said hydraulic connection upon an increase in pressure in said first pressure chamber; and said line arrangement comprises:

an overflow line;

said overflow line is configured and disposed to connect said first pressure chamber and said at least one additional pressure chamber to permit flow of fluid between said first pressure chamber and said at least one additional pressure chamber;

a first connecting line;

a second connecting line;

said first connecting line and said second connecting line are configured and disposed to connect said second pressure chamber to said overflow line to permit flow of fluid between said second pressure chamber and at least one of said first pressure chamber and said at least one additional pressure chamber;

said second connecting line comprises a non-return valve; and said non-return valve is configured and disposed to permit flow of fluid to said second pressure chamber from said at least one of said first pressure chamber and said at least one additional pressure chamber through said second connecting line, and to substantially prevent the flow of fluid from said second pressure chamber to said at least one of said first pressure chamber and said at least one additional pressure chamber through said second connecting line.

3. The door closing apparatus according to claim 2, wherein said second channel is located in one of said pressure piston and said apparatus housing.

4. The door closing apparatus according to claim 3, wherein:

said pressure piston comprises an end portion;

said end portion is disposed to contact a fluid medium in said at least one additional pressure chamber;

said end portion is configured to divide said at least one additional pressure chamber into a first section and a second section;

said piston arrangement comprises a flow cross section; and said first section and said second section of said at least one additional pressure chamber are hydraulically connected to one another by said flow cross section.

5. The door closing apparatus according to claim 4, wherein:

said pressure piston comprises a contact surface disposed opposite said end portion;

said extending portion comprises an end surface disposed to face toward said contact surface of said pressure piston; and said end surface of said extending portion being configured to substantially prevent adhesion with said contact surface of said pressure piston upon contact of said end surface of said extending portion with said contact surface of said pressure piston.

6. The door closing apparatus according to claim 5, wherein:

said extending portion comprises a base section disposed opposite said end surface;

said extending portion is connected with said door piston at said base section;

said door piston comprises a piston surface disposed about the base of the extending portion; and said piston surface comprises a radial seal.

7. The door closing apparatus according to claim 6, wherein:

said apparatus housing comprises a first housing section and a second housing section;

said door piston, said extending portion, and said pressure piston are disposed in said first housing section;

said energy storage mechanism is disposed in said second housing section;

said first housing section and said section housing section each comprise a radial threaded portion; and said first housing section and said section housing section are connected by said radial threaded portions.

8. The door closing apparatus according to claim 7, wherein:

said apparatus housing comprises a mounting plate;

said energy storage mechanism is mounted in a stationary manner on said mounting plate;

said mounting plate comprises an adjusting device to axially displace said mounting plate to permit adjustment of the force of the energy storage mechanism; and said adjusting device is accessible from outside of the apparatus housing.

9. The door closing apparatus according to claim 8, wherein:

said energy storage mechanism is one of:

a) a mechanical energy storage mechanism;

b) a hydraulic energy storage mechanism;

c) a pneumatic energy storage mechanism; or d) an electrical energy storage mechanism; and said energy storage mechanism has one of a linear characteristic, in that the displacement of the energy storage mechanism has a corresponding linear increase in force, and a progressive characteristic, in that the displacement of the energy storage mechanism has a greater than corresponding increase in force.

10. The door closing apparatus according to claim 9, wherein:

said isolating valve is one of:

e) mechanically actuatable;

f) hydraulically actuatable;

g) pneumatically actuatable; or h) electrically actuatable; and said isolating valve is a 2-way valve;

said door closing apparatus comprises a control line;

said control line being configured and disposed to connect said isolating valve and said first pressure chamber to permit the closing of said isolating valve upon an increase in pressure in said first pressure chamber;

said first connecting line comprises a choke;

said non-return valve runs substantially parallel to said choke;

said overflow line comprises a choke;

said overflow line comprises an overflow valve which runs substantially parallel to said choke of said overflow line; and said overflow valve being configured and disposed to substantially prevent the flow of a fluid medium toward said first pressure chamber.

11. Door closer with a door piston, which door piston acts on a driven shaft and has an extension, a pressure piston and an energy storage mechanism which acts on the pressure piston, which pistons are guided so that they can move axially in a housing; and with a first pressure chamber and a second pressure chamber which are connected by means of an overflow line and are operatively connected with the door piston, a middle pressure chamber which is operatively connected with the extension and the pressure piston, and at least one additional pressure chamber which is operatively connected with the pressure piston; the overflow line has a choke and the pistons or the housing have respective channels connecting the second and middle pressure chambers and connecting the middle and the at least one additional pressure chambers, and the door piston is effectively connected, first hydraulically and then mechanically, in positive or form-fitting contact by means of a stepped extension in an opening direction with the pressure piston, and in a closing direction opposite the opening direction so that it can be hydraulically uncoupled from the pressure piston.

12. Door closer as claimed in claim 11, wherein the middle pressure chamber is hydraulically connected on one hand with the second pressure chamber by means of a channel that corresponds to the extension of the door piston and can be closed or opened as a function of the direction of displacement of the door piston, and on the other hand with the additional pressure chamber by means of a channel which has a non-return valve which acts in the direction away from the middle pressure chamber; and that the second pressure chamber is hydraulically connected to the additional pressure chamber by means of a channel which has a non-return valve, and the second pressure chamber is hydraulically connected to the additional pressure chamber with the overflow line and with a channel which has an isolating valve which is normally open, which isolating valve is switched into its isolating position when the pressure in the first pressure chamber increases.

13. Door closer as claimed in claim 12, wherein the channel connecting the middle pressure chamber and the additional pressure chamber, plus the non-return valve, is located in the pressure piston or housing.

14. Door closer as claimed in claim 13, wherein the at least one additional pressure chamber is divided into a first part and second part, whereby the chambers are hydraulically connected to one another by means of a flow cross section which can be realized so that it acts as a choke.

15. Door closer as claimed in claim 14, wherein the door piston has a surface, the pressure piston has a surface, the door piston surface is disposed to face the pressure piston surface, and the piston surfaces facing one another of the two pistons are configured so that they are prevented from sticking together by adhesion.

16. Door closer as claimed in claim 15, wherein the side of the door piston which has the piston surface has a radial seal; the two pistons have one housing and the energy storage mechanism has an additional housing; the two housings are coupled to one another by means of a radial threaded connection; and the additional housing has an externally accessible adjustment means which corresponds to the energy storage mechanism.

17. Door closer as claimed in claim 16, wherein the energy storage mechanism is realized in the form of a mechanical, hydraulic, pneumatic or electrical energy storage mechanism, whereby it can have a linear characteristic, in that the displacement of the energy storage mechanism has a corresponding linear increase in force, or a progressive characteristic, in that the displacement of the energy storage mechanism has a greater than corresponding increase in force.

18. Door closer as claimed in claim 17, wherein the actuatable isolating valve is a mechanically, hydraulically, pneumatically or electrically actuatable 2-way valve, whereby corresponding to the first pressure chamber there are means for the pressure-dependent actuation of the isolating valve.

19. Door closer as claimed in claim 18, wherein the overflow line, instead of the choke, parallel to the choke, has a non-return valve that closes the direction of flow from the first pressure chamber to the second pressure chamber.

20. Door closer as claimed in claim 19, wherein the overflow line, instead of the choke, parallel to the choke, has an overflow valve which isolates or cuts off the flow in the direction of flow toward the first pressure chamber.

* * * * *